United States Patent [19]

Wagner et al.

[11] 4,189,098

[45] Feb. 19, 1980

[54] HOUSEHOLD SPRAY APPARATUS

[75] Inventors: Josef Wagner; Heinrich Griebel, both of Friedrichshafen, Fed. Rep. of Germany

[73] Assignee: Spray Tech Corporation, Minneapolis, Minn.

[21] Appl. No.: 889,444

[22] Filed: Mar. 23, 1978

[51] Int. Cl.[2] ..... B05B 9/043

[52] U.S. Cl. ..... 239/127; 239/332

[58] Field of Search ..... 239/332, 124–127; 222/333, 318

[56] References Cited

U.S. PATENT DOCUMENTS

| | | | |
|---|---|---|---|
| 3,623,661 | 11/1971 | Wagner | 239/332 |
| 3,904,116 | 9/1975 | Jones et al. | 239/332 X |

FOREIGN PATENT DOCUMENTS

| | | | |
|---|---|---|---|
| 1033146 | 6/1958 | Fed. Rep. of Germany | 239/332 |
| 2013504 | 10/1970 | Fed. Rep. of Germany | 222/333 |
| 2623324 | 12/1977 | Fed. Rep. of Germany | 239/332 |

*Primary Examiner*—John J. Love

*Attorney, Agent, or Firm*—Hill, Van Santen, Steadman, Chiara & Simpson

[57] ABSTRACT

A compact portable hand held and operated container for household use in dispensing hair spray, cosmetics and the like has a battery operated electric motor driven pump ejecting the contents of the container in mist or spray form through a nozzle without use of an aerosol propellant.

8 Claims, 7 Drawing Figures

HOUSEHOLD SPRAY APPARATUS

The invention relates to a household spray device for the spraying of liquids, as for example, liquid body-care media, or the like, disinfection solutions, chemicals for improvement of the air or the like, other liquid substances, which at the present time are sprayed by means of the known spray-cans.

The harmfulness to the environment of the propellent gases contained in spray cans cannot be overlooked. The propellent gases utilized at the present time, namely, fluoro-hydrocarbons, offer extraordinarily great advantages with reference to the utilization for spray-cans, for which reason spray-cans have made an introduction into practically all areas of daily life. This utilization of spray-cans on the broadest basis, however, leads to a release of appreciable quantities of fluorohydrocarbons, which gives rise to fear of an impairment of the ozone layer surrounding the earth and protecting the same from a too intensive ultraviolet-radiation, and thus fear of severe harm to the environment.

The object serving as basis for the invention is to furnish a household spray-device, which makes it possible, to spray liquids in the same manner as by means of the known spray-cans; these devices are in future to replace the questionable, extraordinarily controversial spray-cans, so that their disadvantageous effects in future are lowered and if possible entirely overcome.

Manual spray-devices have already become known, with the aid of which liquids, especially paints are sprayed or splashed. Such devices have a relatively expensive construction and require a relatively powerful drive-motor, which is carried out generally as oscillating armature motor, in order to supply the required amount of spray. If one were to provide drives for a household spray-device of the type coming into consideration, this device would become relatively large and heavy and additionally dependent on an outside current source. Also, such a spray-device would be unusually expensive, which impairs its utilization on the broadest basis.

Also, a manual atomizer for liquids with a battery-driven drive motor has already become known; in the case of this device, by means of a motor-driven air pump, the liquid is sprayed out of a nozzle by means of an air current, similarly to the case of the known perfume atomizers with rubber-ball bellows. Such a device, however, requires the atomization of air and only a few thinly liquid fluids permit of being atomized, whereby the inclusion of these devices is therefore limited. Beyond this, the devices, in spite of an enormous need and necessity, do not appear on the market, —which is explainable due to the countless defects or flaws of these devices.

For the solution of the problem put, it is suggested in accordance with the invention to construct the household spray-device for the spraying of liquids coming under consideration in such manner, that it has a can-shaped storage container for the reception of the liquid to be sprayed, with which a spray-head is loosely connected, in which a pump aggregate driven by means of an electromotor energized by a repeatedly chargeable storage battery is positioned, whose piston lies in a cylinder-bore, which is connected through a suction conduit with the lower area of the supply container containing the liquid, and through a bypass-conduit controlled or guided by means of a locking member, with the inner chamber of the supply container, and which is in connection through the spray-nozzle on the spray-head with the free atmosphere. Instead of a single pump aggregate for the feed of the liquid, if need be also two pump aggregates parallel with one another are arranged, which are driven by one common drive motor.

In the bypass conduit between the pump cylinder and the liquid container, as well if need be in the liquid channel leading to the spray-nozzle, is arranged a shut-off valve releasing or closing the same, which may have the form of a piston- or rotary-shut-off valve. These shut-off valves have the object of making possible the outlet of the liquid to be sprayed out of the spray-nozzle first then when after short time of operation of the electromotor-driven pump aggregate, the liquid pressure is sufficiently high in order to insure an accurate spraying.

It is, however, also possible to correlate in the bypass conduit an excess-pressure valve and the shut-off member to be operated selectively in the pressure-liquid-channel leading to the spray-nozzle. The latter is generally closed, so that with operating motor, the pump aggregate feeds back liquid through the bypass conduit into the liquid container. If the shut-off member is actuated and therewith the pressure-liquid channel leading to the spray-nozzle opened, the check-valve in the bypass-conduit immediately closes, so that the liquid is driven with full pressure out of the spray-nozzle.

Advantageously, the shut-off valve which is under spring pressure, controlling the outlet of liquid from the spray-nozzle is movable into its operating position by a manually operable actuating member or the like seated on the spray-head, against the effect of the spring. The actuating member or the shut-off valve is coupled with an electric switch-contact for the electromotor in such manner, that the drive motor for the pump aggregate is switched on before the shut-off valve has reached its driving or operating position. This serves the purpose of permitting the drive motor to start up, so that the pump aggregate may provide the full liquid pressure then when the shut-off valve closes the bypass conduit.

Suitably, two springs act on the actuating member and or the shut-off valve, respectively, of which the second spring is effective with preferably greater elasticity constant first after the switch contact for the drive motor has been actuated or closed for a short period of time, respectively. This is to bring about that after covering of a short distance the actuating member or the shut-off valve is delayed or retarded in its movement for a short time, so that in the pump cylinder the correspondingly high and required pressure prevails, in order to prevent that upon starting of the pump aggregate the latter already drives small quantities of liquid out of the nozzle and drip off the same,—which is highly undesirable and must therefore be prevented.

The spray nozzle arranged on the spray-head may be arranged at different height. Suitably it consists of an axial prolongation of the pump cylinder, whereby the pump aggregate may be arranged either in the lower, or as the case may be, also in the upper area of the spray-head. It is, however, also possible to arrange the pump aggregate in the lower area, the spray-nozzle, however, at the upper end of the spray-head, and to connect the pump cylinder with the spray-nozzle through a riser or uptake. In each case, according to suitability and desire, the actuating member for the shut-off members may be arranged at desired points, —whether it be at the lower or upper end of the spray-head or also on its upper front surface.

It is of advantage for the use of the device, to construct the same with reference to the spray-head and the control-button similarly to the known spray-cans; for this purpose, the spray nozzle and the control button are located above the upper front surface of the device and form one unit.

Suitably, the household spray device is constructed in the described manner, that is, that the spray-head contains a source of energy in form of a particularly rechargeable stprage battery, in order in this manner to be able to introduce the device universally and independently of sources of energy locally bound (such as plug contacts of an electric power-line). It is, however, of course also possible, additionally to provide on the device a connection for a connecting cable, in order for the purpose of operation at a stationary or local source of energy and or for the purpose of charging of the storage battery, respectively, to be able to attach to a charging device. Firstly, for example, for the case that the storage battery is no longer in position to supply sufficient energy, the device, however, is still to be made use of.

Advantageously, a special mounting is provided for the device, which is adapted to the same in such manner, that it is insertable in the mounting, whereby at the same time, the storage battery is attached to a charging device, which is located in a housing of the mounting. In this way, the storage battery, while the device is resting in the mounting, is always charged again, so that at all times it is completely ready for operation.

In FIGS. 1 to 7 of the drawing, the subject matter of the invention is shown on the basis of especially preferred embodiments by way of example, which are described in the following in greater detail.

Figure 1:
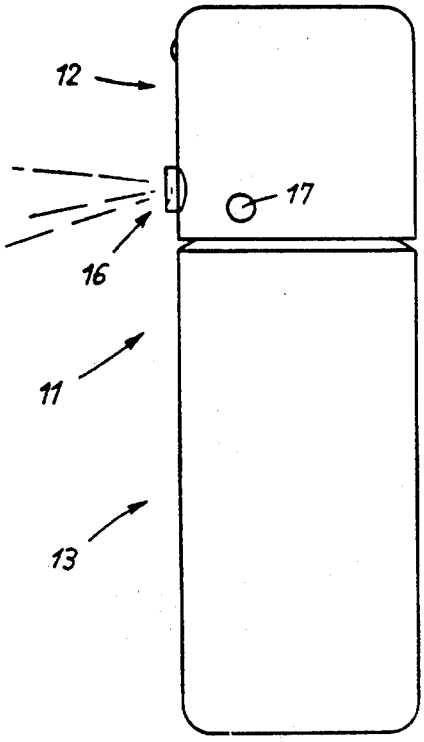
FIG. 1 shows a side view of the household spray-device according to the invention.

As FIG. 1 shows, the household spray-device 11 for the spraying of liquid substances has the form of a can which corresponds in its shape and size approximately to the known spray-cans. In the spray-head 12 disposed on top, are arranged the aggregates which bring about the spraying of the liquid. With the spray-head 12 is exchangeably connected the storage container 13 containing the liquid, out of which the liquid is conveyed out upon starting the pump aggregate 14 by means of the suction conduit 15, in order to permit it to issue out of the spray-nozzle 16.

In order to set the pump aggregate 14 in motion, there is located on the outer side of the spray-head 12 an actuating member in form of a control button 17, through which, on the one hand, the starting of the electromotor 19 energized by the storage battery 18 is brought about, and on the other hand, after a time delay, the shut-off member 20 takes effect, which closes the bypass-conduit 21 between the pressure chamber 22 behind the pump cylinder 23 and the inner chamber of the liquid storage container 13, whereupon the liquid located in the pressure chamber 22 flows out of the outlet opening 24 of the spray-nozzle 16 under high pressure, at the same time in the finest division.

The cylinder 23 of the pump aggregate is advantageously located in a cylinder bushing 25 which is positioned exchangeably in a bore in the lower area of the spray-head 12. The pump piston 26 located in the cylinder bore 23 is set in axial movement to and fro by means of the eccentric 28 seated on the motor shaft 27.

Behind the cylinder bore 23 is located the check-valve 29, which locks the same against the pressure chamber 22. There is connected with the control button 17 of the device an electric switch element 30, whose two contact tongues 31 connect the two contacts 32 or 33, respectively, with one another, whereby the circuit between the storage battery 18 and the electromotor 19 is closed. Upon pressing in the control button 17 in the bore 34 in the spray-head 12 against the effect of the spring 35, first the circuit of the drive or operating motor 19 is closed by means of the switch 30. Upon further and correspondingly heavy pressing-in of the control button 17 in its bearing bore 34 in the spray-head 12, the bypass conduit 21 is closed by means of the shut-off valve 20, so that the liquid required upon starting of the pump aggregate 14 is no longer carried out of the pressure chamber 22 by means of the bypass conduit 21 having a relatively large cross-section, but is then forced to pass out through the outlet opening 24 of the spray nozzle 16 into the free atmosphere. If the control button is released, the spring 35 immediately presses it back, whereby the bypass conduit 21 is again released, so that then liquid still conveyed again flows back into the storage container 13. Thereby it is prevented that the spray nozzle then drips in undesired manner.

The operating motor 19 is advantageously positioned with vertical shaft in the spray-head 12, and indeed eccentrically to its axis. The storage battery 18 is advantageously formed in such manner, that it lies adjacent the operating motor and accordingly partially surrounds the same; it is for this purpose constructed kidney-shaped in cross-section and consists advantageously of a housing in which are introduced several rechargeable battery cells, which are connected in corresponding manner conductively with one another. The housing possesses two contact pins, which upon introduction of the storage battery 18 in the spray-head 12 are inserted in two bushings in the circuit of the device.

The rear end of the cylinder bore 23 of the pump aggregate 14 may discharge or end in an annular chamber 36, which is in connection through a bore 37 with the inner chamber of the storage container 13, in order to carry off leaking liquid which has passed through between cylinder wall and piston, so that the latter cannot come in contact with the driving or operating mechanism of the piston.

Advantageously, the pump aggregate is demountable in simple manner, in order easily to clean the piston and the cylinder sleeve and to be able to release residues of liquid or exchange these parts respectively, if desired, in simple manner.

Figure 5:
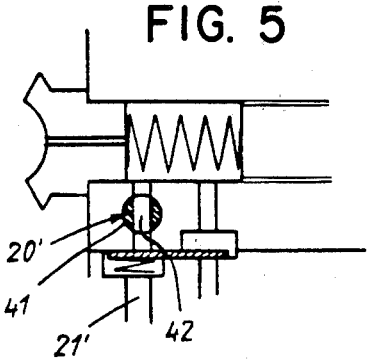
FIGS. 5 to 7 show axial sections through the device in the area of the control elements for the outlet of the liquid out of the spray-nozzle, whereby the control elements have different forms.

In the embodiment by way of example shown in FIG. 5 of the shut-off member 20' in the bypass conduit 21', a slide-valve 41 is used, in which is arranged a fluid or liquid flow-through bore 42. The slide-valve 41 is axially movable to and fro and closes either with its shaft the upper part of the bypass conduit 21' or releases the same with the shaft bore 42.

Figure 6:
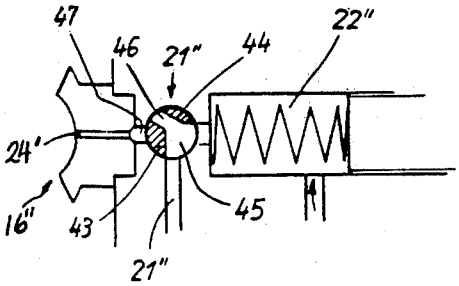
Figure 4:
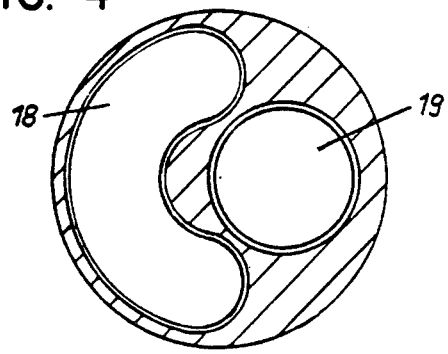
FIG. 4 shows a section through the upper part of the spray-head of the device according to FIGS. 1 to 3.

In the embodiment by way of example according to FIG. 6, a rotary slide-valve 43 is used as shut-off member 21'', whose shaft 44 has a recess 45 extending over about 90°, and a passage bore 46. After starting of the pump aggregate, the liquid flows out of the pressure chamber 22'' back through the recess 45 and the bypass conduit 21'' into the inner chamber of the storage container. Upon rotation of the rotary slide-valve 43, the mouth or opening of the bypass conduit 21'' is closed and the outlet channel 47 leading to the spray-nozzle 16'' is opened thereby that the passage bore 46 is brought into flush position with the same.

Figure 7:
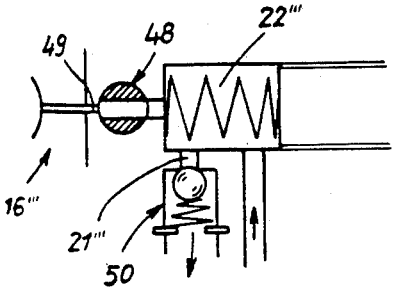
Figure 2:
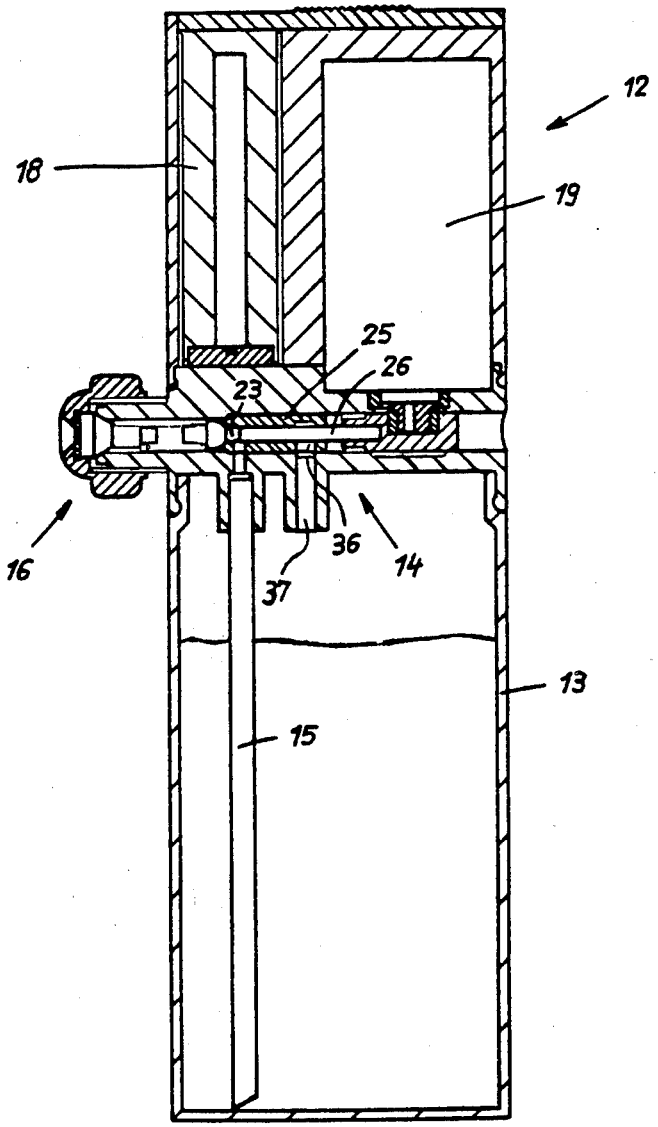
FIG. 2 shows an axial section through the device according to FIG. 1.
Figure 3:
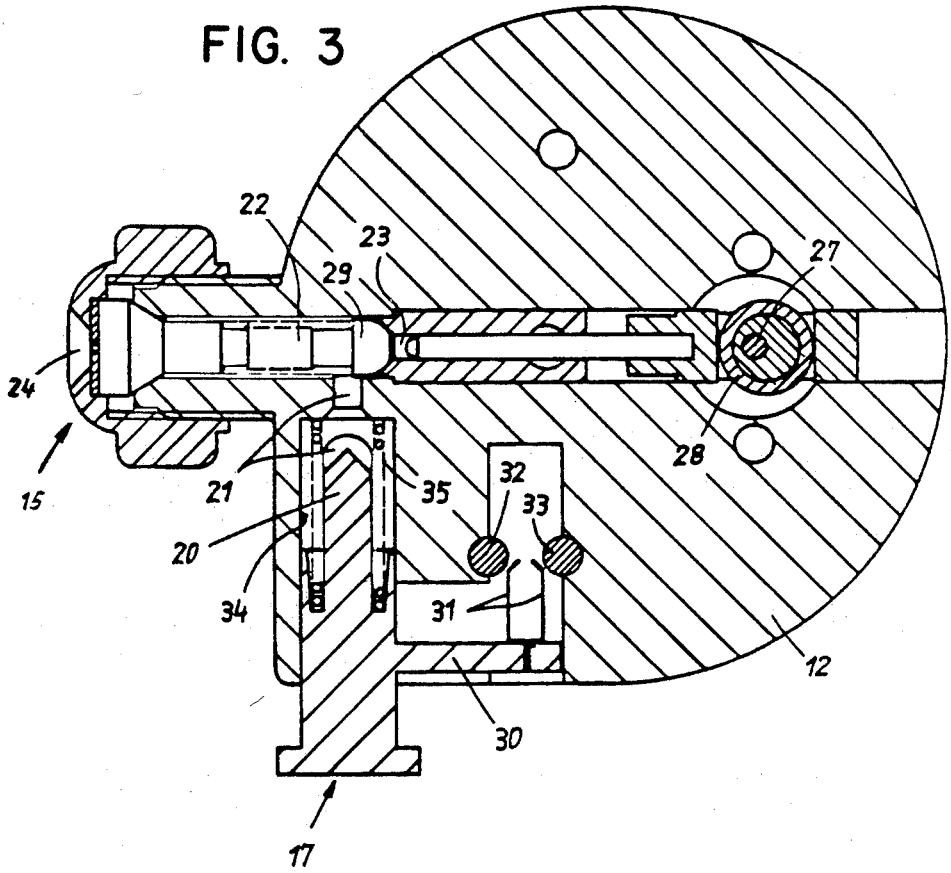
FIG. 3 shows a cross-section through the device in the plane of the pump aggregate and the spray-nozzle.

FIG. 7 shows a further embodiment. In the latter, a rotary slide-valve 48 is located in the liquid outlet channel 49 between the pressure chamber 22''' and the spray nozzle 16'''. In the bypass conduit 21''' is located the check valve 50, which with opened rotary slide valve 48 closes the bypass conduit 21'''. The strength of the spring of the check valve 50 is for the purpose dimensioned correspondingly to keep the bypass closed when the valve 48 is opened.

We claim:

1. A household spray device for the spraying of liquids without air polluting propellants which comprises an open top canister for the reception of the liquid to be sprayed, a cap detachably mounted on said canister closing the open top thereof, an electric motor mounted in said cap, a pump mounted in said cap driven by said motor, a spray nozzle on said cap, said pump having an inlet conduit depending from the cap into the bottom of the canister, and an outlet supplying liquid to said spray nozzle, a bypass passageway in said cap between the pump outlet and spray nozzle returning liquid from the pump to said canister, a valve controlling flow through said bypass passageway, a battery mounted in said cap for energizing said electric motor, a switch in said cap having an actuator controlling current flow from said battery to said motor, and a single means including a valve stem rigidly connected to the switch actuator which valve stem operates to close the valve in the bypass passageway, said single means being mounted in said cap and accessible from the exterior of the cap to be manually actuated for successively closing said switch and said valve and for successively opening said valve and said switch whereby the pump will initially recirculate liquid back to the canister before discharging the liquid through the spray nozzle and liquid will drain back to the canister to prevent dripping of liquid from the nozzle when the pump is stopped.

2. The spray device of claim 1 including a cylindrical bore in said cap discharging to said spray nozzle and communicating with said inlet conduit and said bypass passageway, a pump piston reciprocating in said bore, and a spring biased check valve in said bore between said inlet conduit and said spray nozzle receiving liquid pumped by said piston and opening only when the valve closes the bypass passageway.

3. The spray device of claim 1 wherein the single means includes a spring biased button which is manually depressed to close the switch and valve and released to open the valve and switch.

4. The spray device of claim 1 wherein the electric motor has an eccentric rotor and the pump has a piston driven by the rotor.

5. The spray device of clam 1 wherein the cap has a kidney shaped recess receiving the battery.

6. The spray device of claim 1 including a spring biased valve in said bypass passageway opening under excess pressure from the pump.

7. The spray device of claim 1 wherein the single means is a spring biased push button with a pin member closing said bypass passageway and spring fingers engaging battery contacts control the current flow from the battery to the motor.

8. The spray device of claim 1 wherein the battery is rechargeable.

* * * * *